US009067121B1

(12) United States Patent
Beard et al.

(10) Patent No.: US 9,067,121 B1
(45) Date of Patent: Jun. 30, 2015

(54) SWIM PACING DEVICE

(71) Applicants: Donald G Beard, Rogers, AR (US); Jebediah E Turner, Bentonville, AR (US); Patrick E Turner, Rogers, AR (US)

(72) Inventors: Donald G Beard, Rogers, AR (US); Jebediah E Turner, Bentonville, AR (US); Patrick E Turner, Rogers, AR (US)

( * ) Notice: Subject to any disclaimer, the term of this patent is extended or adjusted under 35 U.S.C. 154(b) by 131 days.

(21) Appl. No.: 14/044,033

(22) Filed: Oct. 2, 2013

(51) Int. Cl.

| | |
|---|---|
| ***A63B 71/00*** | (2006.01) |
| ***A63B 31/00*** | (2006.01) |
| ***A63B 71/06*** | (2006.01) |
| ***A63B 69/12*** | (2006.01) |

(52) U.S. Cl.
CPC ..... *A63B 71/0686* (2013.01); *A63B 31/00* (2013.01); *A63B 69/12* (2013.01)

(58) Field of Classification Search
CPC ..... A63B 31/00; A63B 69/12
See application file for complete search history.

(56) References Cited

U.S. PATENT DOCUMENTS 5,325,340 A 6/1994 Ramsey
6,086,379 A 7/2000 Pendergast et al.

FOREIGN PATENT DOCUMENTS

GB 25036779 A * 1/2014 ..... A63B 69/12
WO WO8503881 A1 * 9/1985 ..... A63B 69/12

OTHER PUBLICATIONS

Commercial product located online at http://www.aqvatech.it/web/en/swimming/virtual-trainer-2-fix/ and attached for reference.
Commercial product located online at http://pacer2swim.com/?page_id=7 and attached for reference.

* cited by examiner

*Primary Examiner* — Oren Ginsberg

(57) ABSTRACT

A swim pacing device for providing a real time visual reference to a swimmer of a given pace. The swim pacing device comprises a waterproof strand of signal lights, a programmable control, a cord reel, and a low voltage battery power source. The strand of signal lights is placed in the water along the bottom of a pool and the signal lights are independently illuminated by the controller according to a pre-defined pace. It is not necessary to orient the strand of lights upward since the signal lights are viewable from all directions. The control is preferably permanently integrated into the cord reel and the means for wiring and control is simplified creating a single piece low cost reliable device.

18 Claims, 5 Drawing Sheets

SWIM PACING DEVICE

CROSS-REFERENCE TO RELATED APPLICATIONS

This application claims the benefit of PPA application Ser. No. 61/708,701, filed Oct. 2, 2012 by the present inventors, which is incorporated by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND

Prior Art

Historically in sports such as biking, swimming, and running the athlete has desired feedback about their actual physical location versus some desired pace. In the past decade devices utilizing global positioning (GPS) technology have become common place for filling that need for both biking and running. These devices are able to display visual feedback to the athlete about where they are currently located as compared to a preset pace. However, challenges with reliability and accuracy of GPS technology have prevented similar devices from being widely utilized for swimming.

A few devices have utilized a light strand with individually illuminating signal lights strung across a pool and connected to a programmable control unit to allow a swimmer to see and follow a preset pace as displayed by the sequence and position of the illuminating lights. An example of one portable device utilizing this technology can be seen in U.S. Pat. No. 6,086,379A published Jul. 11, 2000. Furthermore, two similar devices are currently offered for sale; the Myrtha Pools Virtual Trainer by Aqvatech and Pacer by Kulzertec. These devices can be permanently installed or preferably used portably so they can be installed for a single use during a swim session.

Although these devices offer the feedback that a swimmer desires they have some disadvantages, which when overcome by the present invention offer the swimmer a preferred experience. One of the major drawbacks to the swimmer of these prior art devices is the need to orient the signal lights toward the swimmer. The signal lights in these devices are located on only one side of the signal wire strand and inherently make it difficult or impossible for the swimmer to see that a light is illuminated if it is facing away from the swimmer, where the signal wire strand is physically blocking view of the signal light. Therefore, in order to work properly the swimmer must carefully place the signal wire strand so that it does not twist and faces the correct direction during installation.

A second disadvantage to these prior art devices is the need for expensive and complex circuit boards and controls in order to independently illuminate the signal lights. In the case of all devices and especially underwater devices reliability decreases and cost increases as additional components and connections are required. All of the prior art devices require the signal lights to be mounted on a circuit board which utilizes a signal from a programmable controller to illuminate the signal light as desired.

A third disadvantage of the prior art devices is that the programmable control units are separate from the signal wire strand assembly. This inevitably leads to a loss in reliability and increase in cost.

BRIEF SUMMARY OF THE INVENTION

In accordance with one embodiment a swim pacing device comprises a signal wire strand, a reel for winding and containing the signal wire strand, controls integrated into the reel, and a plurality of signal lights which can be viewed from any angle.

Advantages

Accordingly, several advantages of one or more aspects are to improve user friendliness by eliminating the need during installation to orient the signal wire strand so that all signal lights can be seen from a given direction, improved reliability and user friendliness by integrating the controls into the reel, and improved reliability and reduced cost by eliminating the need for a plurality of complex circuit boards. These and other advantages of one or more aspects will become apparent from a consideration of the ensuing description and accompanying drawings.

BRIEF DESCRIPTION OF THE SEVERAL VIEWS OF THE DRAWING

Corresponding reference characters indicate corresponding components throughout the several views of the drawings.

DETAILED DESCRIPTION OF THE INVENTION

The following description is of the best mode presently contemplated for carrying out the invention. The description is not to be taken in a limiting sense, but is made merely for the purpose of describing one or more preferred embodiments of the invention.

Figure 1A:
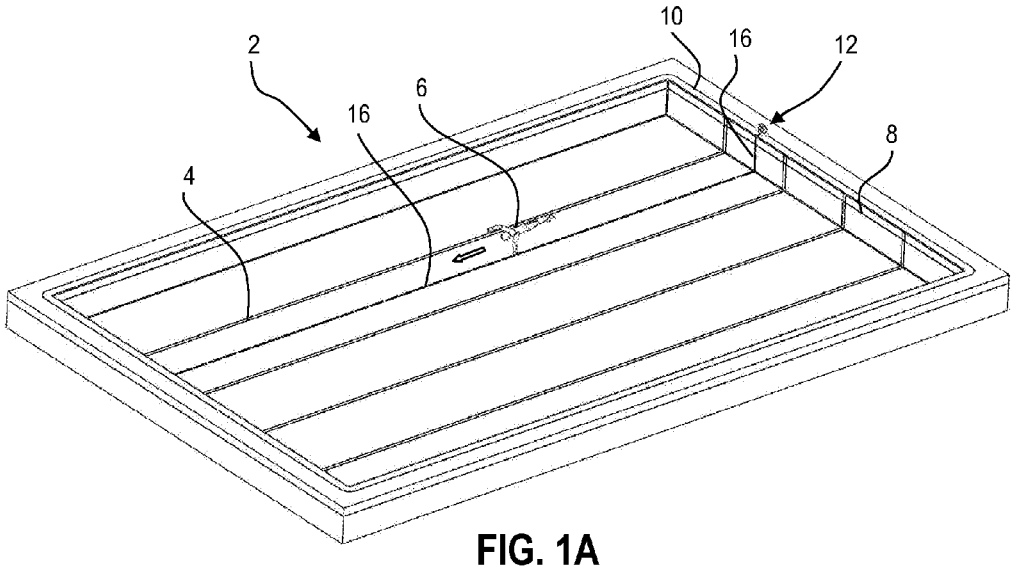
FIG. 1A is a perspective view of a swimming pool 25 meters in length including a swimmer and the swim pacing device according to the present invention.
Figure 1B:
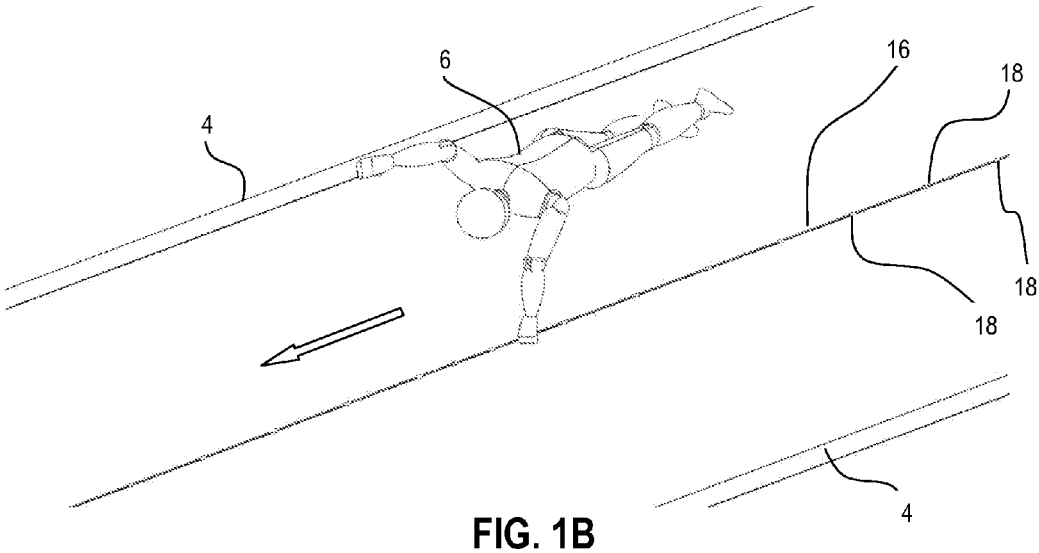
FIG. 1B is a cropped view of FIG. 1A including a portion of the swimming pool, swimmer, and components of the swim pacing device including a portion of the signal wire strand, and multiple signal lights according to the present invention.
Figure 1C:
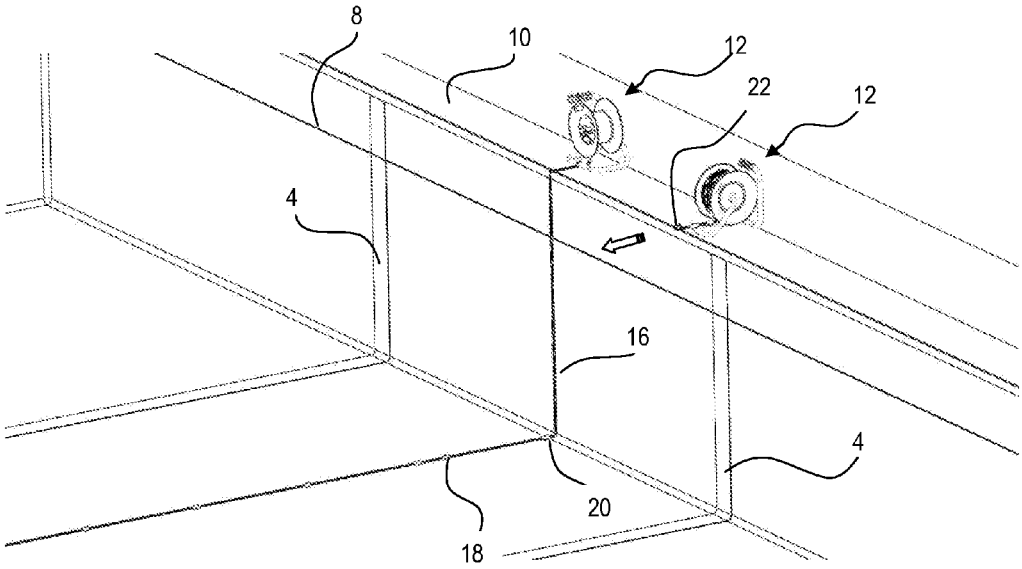
FIG. 1C is a cropped view of FIG. 1A including the right hand portion of the swimming pool and components of two swim pacing devices including the reels, controls, portion of the signal wire strands, signal wire weights, and multiple signal lights according to the present invention. One swim pacing device is shown in use and the second is shown with the signal wire strand wound round the reel and ready for installation in the pool or for transport.
Figure 1D:
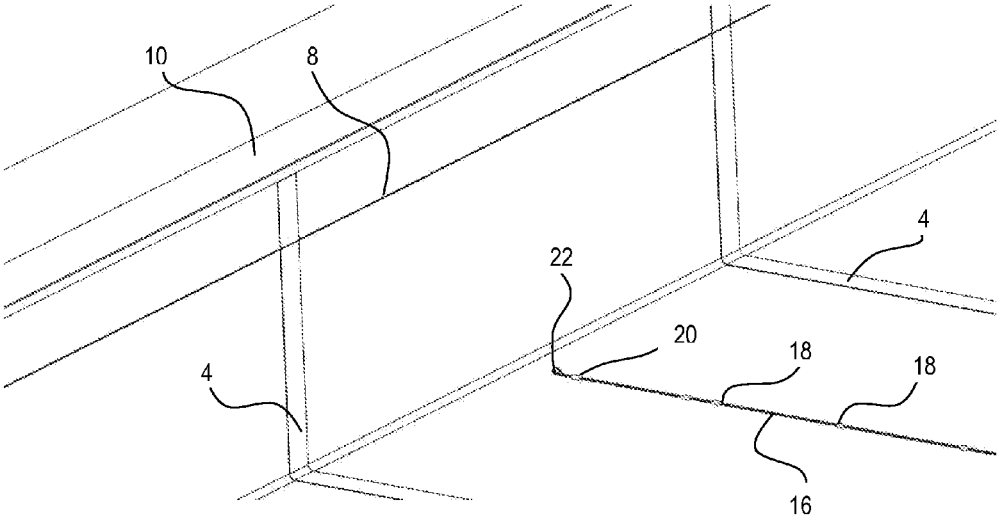
FIG. 1D is an alternative perspective view of the left hand portion of the swimming pool shown in FIG. 1A and includes the end portion of the signal wire strand, the signal wire handle, a signal wire weight, and multiple signal lights according to the present invention.
Figure 2:
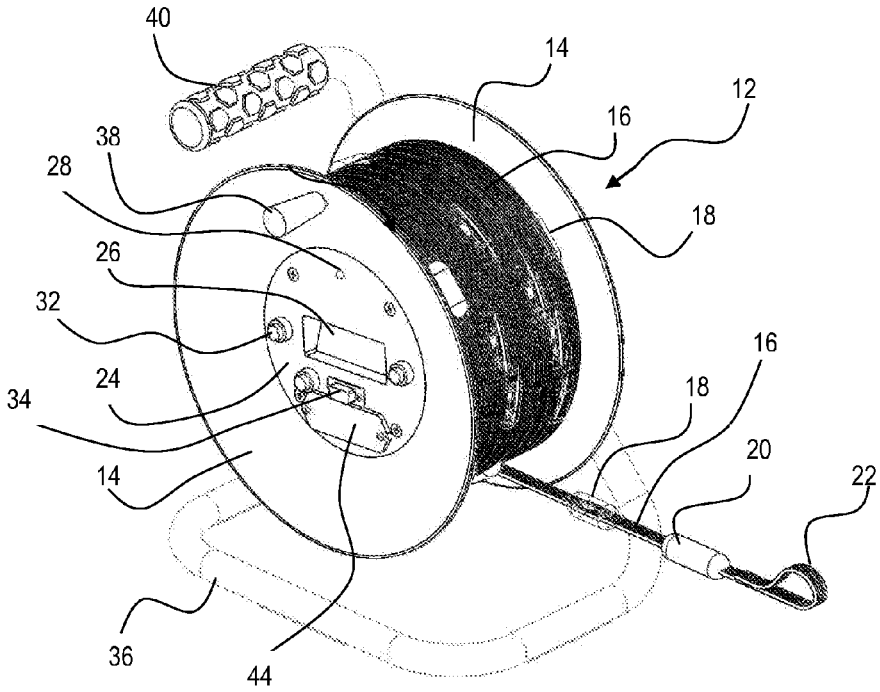
FIG. 2 is a perspective view of the present invention swim pacing device as shown with the signal wire strand and by extension signal lights and signal wire weights wound around the reel and the controls in the upright position.

A preferred embodiment of the present invention swim pacing device 12 is shown in perspective view FIG. 1A, and in further detail in cropped perspective views FIG. 1B, FIG. 1C, and FIG. 1D. Said present invention is shown in a state of use by the swimmer 6 in said views, with the exception of FIG. 1C which also shows an additional swim pacing device in a compact portable state ready for installation or transport. For illustration purposes said views have been shown with water removed, however, the water line 8 is shown for reference. Shown In FIG. 1C are two swim pacing devices 12, one in a state of use and a second in a position ready to be unwound and installed or alternatively transported. As shown in FIG. 2 said swim pacing devices 12 are comprised of controls 24, reels 14, signal wire strands 16, a series of signal lights 18, and multiple signal wire weights 20. The present invention when in a state of use by a swimmer 6 is configured with the controls 24 and reel 14 as shown in FIG. 1C resting atop the pool ledge 10, the controls 24 are in the upright position facing the water and swimmer 6, the signal wire strand 16 is electrically connected to the controls 24, runs across the pool ledge 10 down into the water and is held against the bottom corner of the swimming pool 2 by a signal wire weight 20 as shown in FIG. 1C, the signal wire strand 16 then runs coincident with the bottom surface of the swimming pool 2 and parallel to the pool lane lines 4 as shown in FIG. 1A, FIG. 1B, FIG. 1C, and FIG. 1D, a series of signal lights 18 are incrementally spaced along the length of the signal wire strand 16 and electrically connected to the signal wire strand 16 and further more connected to and individually energized by the controls 24, the signal wire strand 16 is such a length that its endpoint is approximately coincident with the opposing bottom corner of the swimming pool 2 as shown in FIG. 1D, lastly the signal wire strand 16 is held in position at the bottom corner of the swimming pool 2 by a signal wire weight 20 as shown in FIG. 1D. Signal wire weights 20 are preferably 1½ inch diameter and 1½ inches long and made of molded non-corrosive metal such as lead and are incrementally spaced and permanently attached to the signal wire strand 16 as needed to keep the signal wire strand 16 in place. In FIG. 1C the second swim pacing device is shown ready for installation with the controls 24 facing perpendicular to the water and the signal wire handle 22 facing the water. To install the swim pacing device 12 in the swimming pool 2 the user simply grabs the signal wire handle 22 and pulls it down the length of the swimming pool 2 as indicated by the directional arrow until it reaches the full length of the swimming pool 2, thereby unwinding the signal wire strand 16 and letting the incrementally spaced signal wire weights 20 sink and secure the signal wire strand 16 along the bottom of the swimming pool 2. During the unwinding process the reel 14 and the integrated controls 24 will repeatedly rotate 360 degrees about the central axis of the reel 14. The user will complete the installation by turning the reel stand 36 until the controls 24 face the water and manually rotating the reel 14 until the controls 24 are in the upright position. To uninstall the swim pacing device 12 and prepare for transport the user would rotate the reel stand 36 until the controls 24 face perpendicular to the water, rotate the reel 14 by gripping the reel winding handle 38 and rotating repeatedly until the signal wire strand 16 is fully wound around the reel 14.

One advantage of the present invention is the ability to provide a visual signal to a swimmer 6, while swimming, for the purpose of pacing the swimmer 6. In FIG. 1B a swimmer 6 is shown swimming between two pool lane lines 4. Swimmer 6 is shown swimming in the direction indicated by the reference arrow. The reference arrow is not a component of said invention, but merely appears for illustration purposes. According to the present invention the series of signal lights 18 illuminate one at a time in sequence in the direction of the reference arrow at a specified pace. Each signal light 18 when illuminated visually indicates what position in the swimming pool 2 the swimmer 6 should currently be located directly vertical thereof. The signal lights 18 are of such color and brightness that the swimmer 6 can easily see each signal light 18 as it illuminates and while swimming. While illumination one at a time in sequence is the simplest contemplated form of visually pacing the swimmer 6 using the signal lights 18, the signal lights 18 may illuminate in various patterns, sequences, directions, and colors to provide further information to the swimmer 6 and is not limited to pacing information alone. Additionally, it is the purpose of the present invention swim pacing device 12 to provide visual pacing when swimming in both directions parallel to the signal wire strand 16. The signal lights 18 illuminate in sequence both moving away from and towards the reel 14, thereby further indicating what the current location the swimmer 6 should be and the direction they should be swimming. In the preferred embodiment of the swim pacing device 12 green signal lights 18 would primarily pace the swimmer 6, while red signal lights 18 would be located at the ends adjacent each vertical swimming pool 2 wall signaling the swimmer 6 of the upcoming wall and giving instructional cues such as a stop or rest cue. In addition, the most central signal light 18 along the length of the swimming pool 2 would be of a different color than the primary signal lights 18, thereby indicating to the swimmer 6 when the half-way point of the swimming pool 2 has been reached.

A perspective view of the far end of the swim pacing device 12 can be seen in a state of use in FIG. 1D. The signal wire handle 22 shown is for ease of use by the swimmer 6 when installing the device into the swimming pool 2. As shown in FIG. 2 the present invention can be removed from the pool and configured in a much smaller format for easy transport. The signal wire handle 22 allows the swimmer 6 or other person installing the device in the swimming pool 2 a firm grip on the end of the signal wire strand 16 in order to guide and stretch the signal wire strand 16 out straight as desired. In the preferred embodiment of the present invention the signal wire handle 22 would be made of rubber, plastic, or a length of the signal wire strand itself, be approximately four inches triangular, and would be permanently attached to the end of the signal wire strand 16.

A perspective view of the present invention can be seen in FIG. 2. The signal wire strand 16 and by extension the signal lights 18 are shown wrapped around the reel 14 in a compact portable format. The signal wire handle 22, end section of signal wire strand 16, one signal light 18, and one signal wire weight 20 remains unwrapped for illustration purposes, but would also be wrapped around the reel 14 under normal circumstances in the compact portable format. In the preferred embodiment shown in FIG. 2 of the present invention the controls 24 are comprised of a screen 26 used to display information and allow the swimmer 6 or other user to change parameters related to the performance of the swim pacing device 12, a communications port 34 used to transfer data, a plurality of controls buttons 32 which allow for input by the user into the controls 24, a controls signal light 28, preferably visible from a minimum of 100 meters distance, used to give a visual start signal to a swimmer 6 located at either end of the signal wire strand 16, battery compartment 44 to hold the batteries powering the controls 24, and a buzzer 30, visible in FIG. 4B, used to give an audible start signal to a swimmer 6 located at either end of the signal wire strand 16. The aforementioned controls 24 components as described are not intended to be complete or limiting. i.e. additional ports may exist which transfer data, provide remote control, or provide means for charging. The controls signal light 28, buzzer 30, controls buttons 32, battery compartment 44, and screen 26 may be relocated, resized, removed, or increased in occurrence to provide varying functionality for the controls 24.

Figure 3A:
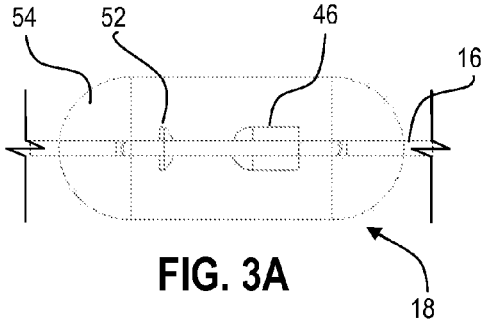
FIG. 3A is a side view of a signal light with the signal wire strand cropped on each end.
Figure 3B:
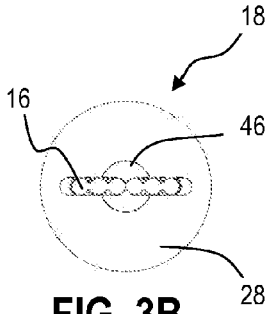
FIG. 3B is an end view of a signal light and a cross sectional view of the signal wire strand.
Figure 3C:
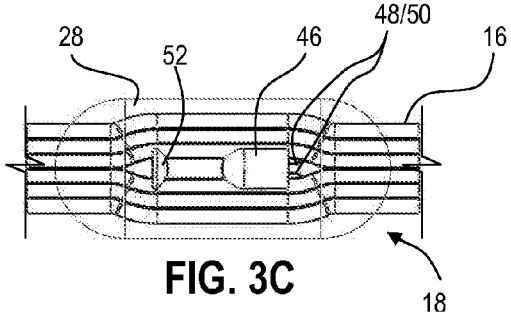
FIG. 3C is a bottom view of a signal light with the signal wire strand cropped on each end.

In the preferred embodiment of the present invention the signal wire strand 16 is approximately 3 meters longer than the length of the swimming pool 2 that it is intended to be used in. For illustration purposes a 25 meter swimming pool 2 was chosen, making the preferred length 28 meters. The signal wire strand 16 is preferably comprised of a plurality of electrical wires, more preferably 7, which are connected to and allow control of 42 signal lights 18. Using the controls 24 each signal light 18 can be individually illuminated. A signal light 18 is shown in detail in FIG. 3A, FIG. 3B, and FIG. 3C. FIG. 3A is a side view of one signal light 18 with the signal wire strand 16 cropped on both sides of the signal light 18. The signal light 18 consists of a single light source 46, which in this preferred embodiment is one super bright LED, and an optional light reflector 52 utilized to further enhance the light source visibility to the swimmer 6 from all directions, all completely enclosed in a sealed water and air tight light enclosure 54 preferably made of molded plastic. As shown in FIG. 3A, FIG. 3B, and FIG. 3C the single light source 46 and light reflector 52 are permanently positioned between electrical wires of the signal light strand 16 in such a way that the single light source 46 can be seen from any direction by the swimmer 6. In the preferred embodiment it is critical that the single light source 46 can be seen from all directions in order to reduce power consumption and manufacturing costs while also allowing the user to completely disregard the random axial direction each signal light 18 is positioned on the floor of the swimming pool 6 when in use, thereby making installation quick and easy. As seen in FIG. 3C the light source 46 is electrically connected to the signal wire strand 16 by contact with the light negative pin 50 and the light positive pin 48. Position of the light source 46 and subsequently the light reflector 52 also changes depending on which individual electrical wires of the signal wire strand 16 it is electrically connected to, but the light source 46 is always visible from any direction by the swimmer 6. The signal lights 18 are preferably approximately 1½ inch in length and ½ inch diameter, made of primarily plastic and are not buoyant. The reel 14 is preferably made of plastic and is approximately 12 inches in diameter and 5 inches in thickness. In the preferred embodiment and as shown in FIG. 4B the controls 24, associated components, and battery compartment 44 are integrated directly into the core of the reel 14 thereby reducing the swim pacing device 12 complexity, size, and cost, while also increasing its reliability because the signal wire strand 16 is directly connected to the controls 24 and does not have to be repeatedly connected and disconnected with use. In this preferred embodiment the controls 24, all accompanying controls buttons 32, the buzzer 30, controls signal light 28, communications port 34, and battery compartment 44 are contained within the core of the reel 14 waterproof plastic shell approximately 6 inches in diameter and 5 inches in width.

Figure 4A:
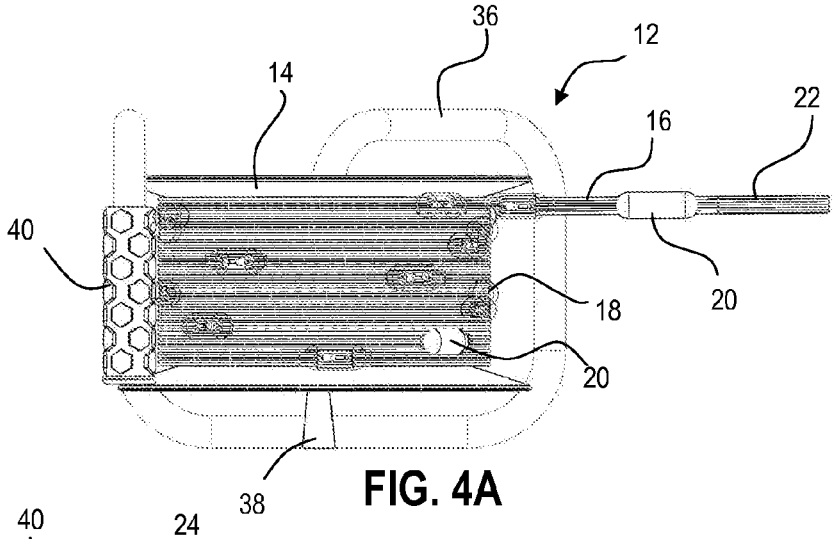
FIG. 4A is a top view of the present invention swim pacing device as shown with signal wire strand, signal wire weights, and signal lights wound around the reel.
Figure 4B:
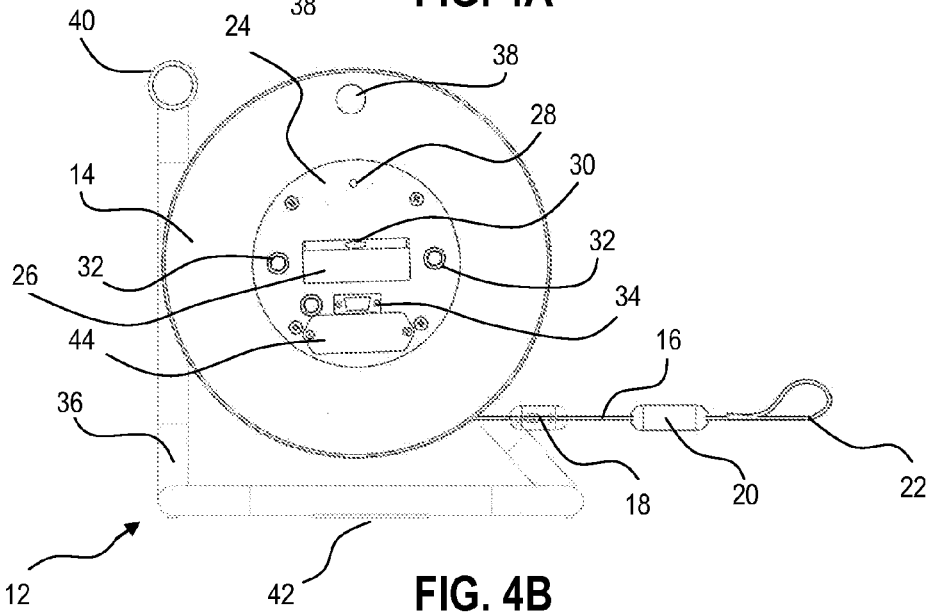
FIG. 4B is a right side view of the present invention swim pacing device as shown with signal wire strand, signal wire weights, and signal lights wound around the reel and the controls in the upright position.
Figure 4C:
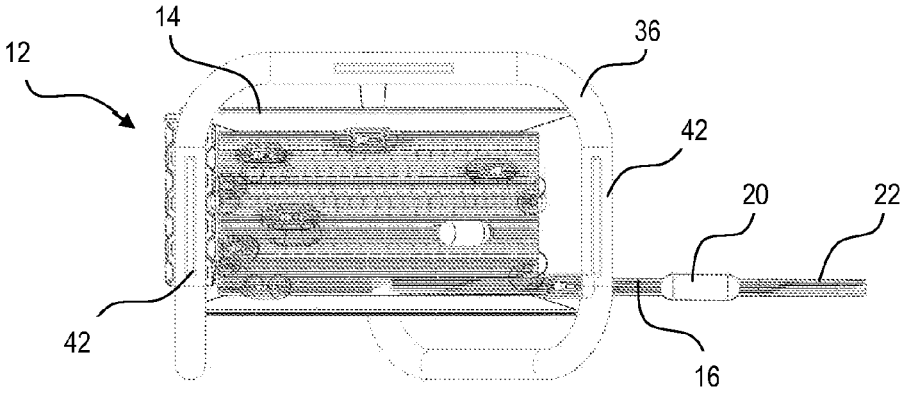
FIG. 4C is a bottom view of the present invention swim pacing device as shown with signal wire strand, signal wire weights, and signal lights wound around the reel.

As shown in FIG. 4A, FIG. 4B, and FIG. 4C the reel stand 36 acts as a frame for the swim pacing device 12, suspending the reel 14 on its rotating axis, providing structure for the carry handle 40, and the reel stand feet 42 made of rubber which grip the pool ledge 10 surface to prevent movement of the reel 40. The carry handle 40 is a ¾ inch diameter, 4 inch long common rubber tube grip used to carry the swim pacing device 12 when transporting. The reel stand 36 is preferably made of light tube steel ¾ inch in diameter, bent as shown to overall dimensions approximately 15" tall, 14 inches long, and 8 inches in width.

A bottom view of the swim pacing device 12 is shown in FIG. 4C. Three reel stand feet 42, preferably made of rubber, are attached to the bottom of the reel 14 as shown. The purpose of the reel stand feet 42 is to provide slip resistance when the swim pacing device 12 is placed onto any surface including a pool ledge 10.

Figure 5:
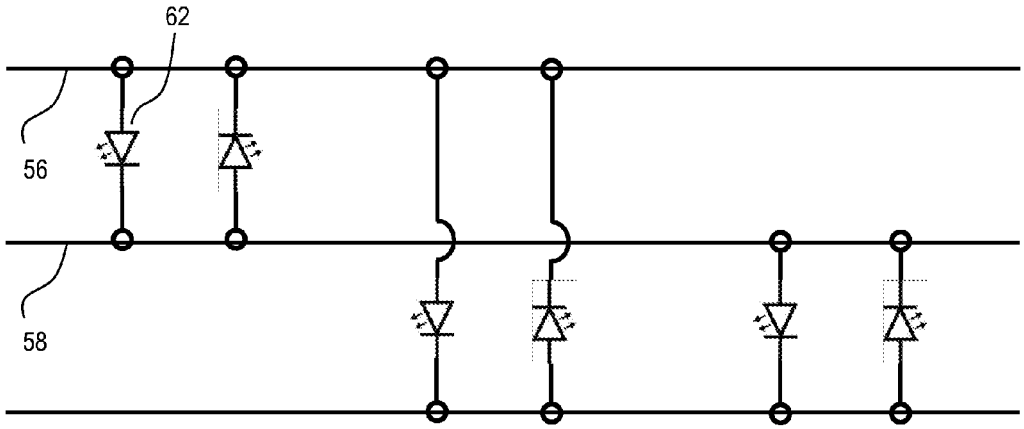
FIG. 5 is an example electrical wire diagram representing how the plurality of signal lights are connected and energized by the signal wire strand.

The electrical wiring method used to connect and energize the signal lights 18 using the signal wire strand 16 is illustrated in the sample electrical diagram in FIG. 5. Most commonly traditional light sources and by historical extrapolation LED light sources have been individually energized using a common negative electrical wire and individual positive electrical wires each energized separately by a controller. Using this common method the 42 individual signal lights 18 of the preferred embodiment would require a signal wire strand consisting of 43 electrical wires. The present embodiment illustrates an innovative electrical wiring method not normally used or considered in order to drastically reduce the number of electrical wires required in the signal wire strand 16 and by extension reduce manufacturing cost. Unlike traditional light sources when using the preferred LED light source 46 or similar technology it is important to note that the light source 46 will only energize when the electrical current is flowing in a given direction, negative to positive. When connected as shown in FIG. 5 only LED A 62 will energize when electrical wire A 56 is negatively charged and electrical wire B 58 is positively charged, no other light sources 46 will energize. By using the controls 24 to change the current of each electrical wire from negative to positive in the signal wire strand 16 and by connecting each LED light source 46 in a series of electrical wires as shown in FIG. 5 the number of electrical wires required in the signal light strand 16 is reduced from 43 to 7. Under the proposed wiring method the maximum number of individually controlled light sources 46 is equal to the number of electrical wires multiplied by the number of electrical wires minus 1. In the proposed preferred embodiment that would be 7 times 6, or 42 LED's.

Figure 6:
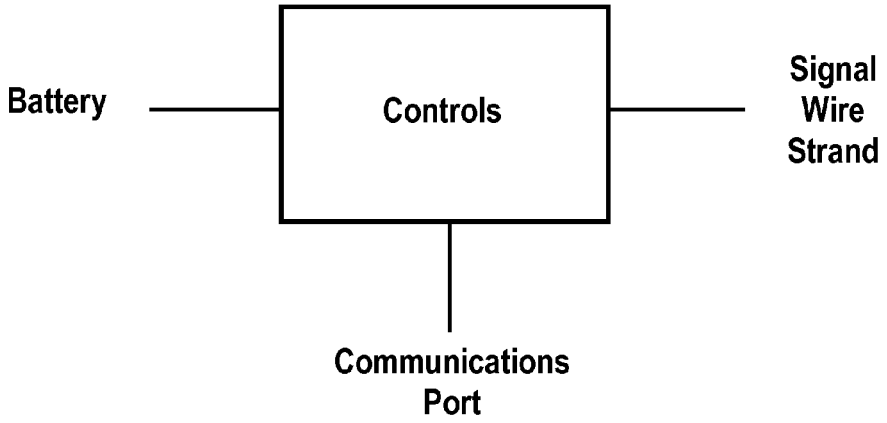
FIG. 6 is a block diagram showing the controls and primary inputs and outputs.

In the preferred embodiment as shown in FIG. 6 the controls 13 would be powered via battery input, transfer data via the communications port 34, and energize signal lights 18 via direct connection to the signal wire strand 16.

To further illustrate the intent and use of the present invention the following scenario would be considered typical. The swimmer 6 utilize the controls 24 and use the screen 26 and controls buttons 32 to create a programmed sequence of illumination events or use an external computing device to create the program and use the communications port 34 to transfer the program data into the controls 24. The swimmer 6 would then install the swim pacing device 12 into the desired swimming pool 2 by transporting it to the swimming pool 2. The swimmer 6 would use the controls buttons 32 to start the program when desired, the controls 24 would illuminate the controls signal light 28 and sound the buzzer 30 to signal the swimmer 6 to begin swimming, the signal lights 18 would begin illuminating in sequence up and down the length of the swimming pool 2 at the programmed pace for the programmed number of pool length cycles ending with a stop illumination sequence signaling the swimmer 6 to either stop for a rest period or stop indefinitely. i.e. the stop sequence might be a steady red signal light 18 located at the desired stop point whereas the typical pacing signal lights 18 being used are green. The controls 24 would complete the desired program which could include many varying paces, rest periods, pool length cycles, etc. When finished the swimmer 6 would uninstall the swim pacing device 12 and lift it by the carry handle 40 for transport.

Advantages

From the description above, a number of advantages of some embodiments of our Swim Pacing Device become evident;

The signal lights are configured in such a way that they are visible to the swimmer regardless of axial orientation. The portability and user friendliness of the present invention is improved over the prior art because the swimmer is not required to tediously place the signal wire strand in a single axial direction so that all of the signal light output is visible during use. This requirement was especially difficult when placed at the bottom of a pool requiring the swimmer to repeatedly dive and orient the signal wire strand.

Secondly, the reel with a permanently integrated control reduces the number of user components to one making portability much more convenient over the prior art. The integration of the control also inherently reduces the number of parts and connections required thereby reducing cost and improving reliability.

In addition, the means presented for connection of the controller and the signal lights utilizing direct current control without the need for additional circuit boards and electrical components inherently reduces cost and increases reliability for the user.

CONCLUSIONS, RAMIFICATIONS, AND SCOPE

Thus the reader will see that at least one embodiment of the swim pacing device improves portability and user friendliness of the swim pacing device while also reducing cost and increasing reliability.

While the above description contains many specificities, these should not be construed as limitations on the scope of any embodiment, but as exemplifications of various embodiments thereof. Many variations and ramifications are possible within the teachings of the various embodiments. For example, a plurality of signal strands may be connected to a single control.

Thus the scope should be determined by the appended claims and their legal equivalents, and not by the examples given.

We claim:

1. A swim pacing device comprising:
- a power source;
- a signal wire strand;
- a plurality of signal lights spaced intermittently along the wire strand;
- a means for positioning the signal lights so light output can be viewed from any angle around the signal wire strand;
- a reel for winding and holding the signal wire strand; and
- a control permanently integrated into the reel and connected to the signal wire strand for illuminating the signal lights independently whereby the signal lights are used by a swimmer as a visual reference of a pace.

2. The swim pacing device of claim 1, further comprising a means for independent and direct current illumination of the signal lights whereby the maximum number of individually controlled signal lights is equal to the total number of electrical wires multiplied by the total number of electrical wires minus 1.

3. The swim pacing device of claim 1, further comprising a means for measuring biometric, actual performance data, or physical location from a swimmer and automatically adjusting the control accordingly.

4. The swim pacing device of claim 1, further comprising a means of wireless control.

5. The swim pacing device of claim 1, wherein the signal light strand is a ribbon cable in which all electrical wires are run parallel in the same plane.

6. The swim pacing device of claim 1, wherein the signal lights are comprised of a single light source configured such that light output can be viewed from any angle around the signal wire strand.

7. A swim pacing device comprising:
- a power source;
- a signal wire strand;
- a plurality of signal lights spaced intermittently along the wire strand;
- a means for positioning the signal lights so light output can be viewed from any angle around the signal wire strand;
- a reel for winding and holding the signal wire strand;
- a control connected to the signal wire strand for illuminating the signal lights independently whereby the signal lights are used by a swimmer as a visual reference of a pace; and
- a means for independent and direct current illumination of the signal lights whereby the maximum number of individually controlled signal lights is equal to the total number of electrical wires multiplied by the total number of electrical wires minus 1.

8. The swim pacing device of claim 7, wherein the control is permanently integrated into the reel.

9. The swim pacing device of claim 7, further comprising a means for measuring biometric, actual performance data, or physical location from a swimmer and automatically adjusting the control accordingly.

10. The swim pacing device of claim 7, further comprising a means of wireless control.

11. The swim pacing device of claim 7, wherein the signal light strand is a ribbon cable in which all electrical wires are run parallel in the same plane.

12. The swim pacing device of claim 7, wherein the signal lights are comprised of a single light source configured such that light output can be viewed from any angle around the signal wire strand.

13. A swim pacing device comprising:

a power source;

a signal wire strand;

a plurality of signal lights spaced intermittently along the wire strand;

a means for positioning the signal lights so light output can be viewed from any angle around the signal wire strand;

a reel for winding and holding the signal wire strand; and a control permanently integrated into the reel and connected to the signal wire strand for illuminating the signal lights independently whereby the signal lights are used by a swimmer as a visual reference of a pace.

14. The swim pacing device of claim 13, further comprising a means for independent and direct current illumination of the signal lights whereby the maximum number of individually controlled signal lights is equal to the total number of electrical wires multiplied by the total number of electrical wires minus 1.

15. The swim pacing device of claim 13, further comprising a means for measuring biometric, actual performance data, or physical location from a swimmer and automatically adjusting the control accordingly.

16. The swim pacing device of claim 13, further comprising a means of wireless control.

17. The swim pacing device of claim 13, wherein the signal light strand is a ribbon cable in which all electrical wires are run parallel in the same plane.

18. The swim pacing device of claim 13, wherein the signal lights are comprised of a single light source configured such that light output can be viewed from any angle around the signal wire strand.

* * * * *